US010287812B2

(12) United States Patent
Rihtarec et al.

(10) Patent No.: US 10,287,812 B2
(45) Date of Patent: May 14, 2019

(54) DEVICE FOR MOVING A MOVABLE FURNITURE PART, AND ITEM OF FURNITURE HAVING A DEVICE FOR MOVING A MOVABLE FURNITURE PART

(71) Applicant: Grass GmbH, Hoechst (AT)

(72) Inventors: Filip Rihtarec, Fussach (AT); Markus Albrecht, Lustenau (AT)

(73) Assignee: Grass GmbH, Hoechst (AT)

( * ) Notice: Subject to any disclaimer, the term of this patent is extended or adjusted under 35 U.S.C. 154(b) by 69 days.

(21) Appl. No.: 15/239,102

(22) Filed: Aug. 17, 2016

(65) Prior Publication Data

US 2017/0049236 A1 Feb. 23, 2017

(30) Foreign Application Priority Data

Aug. 21, 2015 (DE) ..... 20 2015 104 434 U

(51) Int. Cl.

*A47B 88/463* (2017.01)
*E05F 1/16* (2006.01)
*E05F 5/00* (2017.01)

(52) U.S. Cl.

CPC ..... *E05F 1/16* (2013.01); *A47B 88/463* (2017.01); *E05F 5/003* (2013.01); (Continued)

(58) Field of Classification Search

CPC ..... E05F 1/16; E05F 5/003; A47B 88/0477; A47B 88/463

See application file for complete search history.

(56) References Cited

U.S. PATENT DOCUMENTS 3,854,785 A * 12/1974 Manner ..... E05C 19/022 292/DIG. 4
8,109,582 B2 * 2/2012 Dubach ..... E05B 65/46 312/319.1

(Continued)

FOREIGN PATENT DOCUMENTS

AT 514064 A4 10/2014
DE 20 2011 104 824 U1 11/2012

(Continued)

OTHER PUBLICATIONS

German Search Report (Application No. 20 2015 104 434.8) dated May 11, 2016.

(Continued)

*Primary Examiner* — Daniel J Troy
*Assistant Examiner* — Timothy M Ayres
(74) *Attorney, Agent, or Firm* — Burr & Brown, PLLC

(57) ABSTRACT

A device for moving a movable furniture part, the device including a force accumulator such that by way of the device which is fitted to the item of furniture the movable furniture part in the case of an opening procedure under the action of the force accumulator by way of an ejector is capable of being put in an opening position. According to the present invention, a coupling assembly which in the case of the charging procedure of the force accumulator is effective between the ejector and the force accumulator is provided, and that the ejector is designed in a manner that the latter in the region of the end of the path thereof in the case of the opening procedure by way of a switch element couples to the coupling assembly.

9 Claims, 9 Drawing Sheets

(52) U.S. Cl.
CPC ... *E05Y 2201/426* (2013.01); *E05Y 2201/624* (2013.01); *E05Y 2600/12* (2013.01); *E05Y 2900/20* (2013.01)

(56) References Cited

U.S. PATENT DOCUMENTS

| | | | | |
|---|---|---|---|---|
| 8,474,925 | B2 * | 7/2013 | Koenig | E05B 65/46 312/333 |
| 9,386,851 | B2 * | 7/2016 | Dubach | A47B 88/0477 |
| 9,655,447 | B2 * | 5/2017 | Brunnmayr | E05F 5/003 |
| 9,657,506 | B2 * | 5/2017 | Bantle | E05F 1/16 |
| 2009/0307869 | A1 * | 12/2009 | Salice | E05C 19/022 16/85 |
| 2013/0134852 | A1 * | 5/2013 | Salice | A47B 88/47 312/319.1 |
| 2015/0091424 | A1 * | 4/2015 | Nuckolls | A47B 88/433 312/319.1 |
| 2015/0374123 | A1 * | 12/2015 | Goetz | E05B 65/462 312/319.1 |
| 2015/0374125 | A1 * | 12/2015 | Goetz | A47B 88/463 312/319.1 |
| 2016/0007749 | A1 | 1/2016 | Brunnmayr | |
| 2017/0049232 | A1 * | 2/2017 | Rihtarec | A47B 88/463 |
| 2017/0049234 | A1 * | 2/2017 | Albrecht | E05F 15/00 |
| 2017/0051813 | A1 * | 2/2017 | Karu | E05F 1/16 |
| 2017/0079430 | A1 * | 3/2017 | Goetz | A47B 88/477 |

FOREIGN PATENT DOCUMENTS

| | | | |
|---|---|---|---|
| DE | 20 2012 003 537 | U1 | 7/2013 |
| WO | 2014/165873 | A1 | 10/2014 |

OTHER PUBLICATIONS

Extended European Search Report (Application No. 16183680.4) dated Jan. 12, 2017.

* cited by examiner

DEVICE FOR MOVING A MOVABLE FURNITURE PART, AND ITEM OF FURNITURE HAVING A DEVICE FOR MOVING A MOVABLE FURNITURE PART

This application claims the benefit under 35 USC § 119(a)-(d) of German Application No. 20 2015 104 434.8 filed Aug. 21, 2015, the entirety of which is incorporated herein by reference.

FIELD OF THE INVENTION

The present invention relates to a device for moving a movable furniture part and an item of furniture having a device for moving a movable furniture part.

BACKGROUND OF THE INVENTION

Various embodiments of a device for moving a movable furniture part in relation to a basic furniture structure of an item of furniture are known in the prior art, in the case of which the movable furniture part by way of guide means is capable of being put in an opening direction and in a closing direction which is counter to the opening direction, wherein the device has a force accumulator. Under the action of the force accumulator, it is possible by way of an ejector to eject the movable furniture part in an opening direction, that is to say, to put the movable furniture part in an opened position.

Charging of the force accumulator may be performed in the case of the movable furniture part being completed opened as well as closed in relation to a basic furniture structure.

SUMMARY OF THE INVENTION

The present invention is based on the object of providing a device for moving a movable furniture part or an item of furniture, respectively, in which a charging procedure of a force accumulator is improved.

The present invention proceeds from a device for moving a movable furniture part in an opening direction in relation to a basic furniture structure of an item of furniture, wherein the movable furniture part by way of guide means is capable of being put in the opening direction and in a closing direction which is counter to the opening direction and wherein the device has a force accumulator such that by way of the device which is fitted to the item of furniture the movable furniture part in the case of an opening procedure under the action of the force accumulator by way of an ejector is capable of being put in an opening position.

The core concept of the present invention now lies in that a coupling assembly which in the case of the charging procedure of the force accumulator is effective between the ejector and the force accumulator is provided, and that the ejector is designed in a manner that the latter in the region of the end of the path thereof in the case of the opening procedure by way of a switch element couples to the coupling assembly.

By way of this measure it may be achieved that the ejector by way of a charging procedure of the force accumulator in the case of a closing movement of the movable furniture part following opening of the movable furniture part by way of the coupling assembly is operationally connected to the force accumulator for a preferred transmission of force from the ejector to the force accumulator.

For example, an amplification of a charging force, acting on the ejector, to the force accumulator may be achieved by way of the coupling assembly, for example, by amplification by way of a lever assembly which is effective in the coupling assembly.

On the other hand, the ejector, for example, for an opening procedure of the movable furniture part, may be in direct contact with the force accumulator, with the coupling assembly not being effective during this phase. This is to say that the force accumulator then acts directly, without the interdisposed coupling assembly, and thus without a reduction in force which would then be effective in this direction. Rather, the force is transmitted directly from the force accumulator to the movable furniture part, in particular, by way of the ejector.

The coupling assembly comprises a plurality of levers which are operationally interconnected, for example. The movable furniture part may be a drawer or a wardrobe door, for example.

In one further preferred design embodiment of the present invention, the switch element on the ejector in relation to the device is configured in a manner that the ejector is capable of being operationally connected to the coupling assembly for a charging procedure of the force accumulator when an entrainment element assumes a predefined position in relation to the ejector.

For example, the ejector is capable of being operationally connected to the coupling assembly when an entrainment element of the guide means on the basic furniture structure or on the movable furniture part, or an entrainment element which is attached directly to the basic furniture part, respectively, in the case of the opening procedure departs from the ejector.

Advantageously, the switch element is configured on the ejector in such a manner that the former interacts with the entrainment element such that the ejector is entrained by the entrainment element in the case of a movement in the opening direction.

Furthermore, the switch element is favorably designed on the ejector in such a manner that the switch element may couple to the entrainment element exclusively in the case of an opening movement of the movable furniture part.

It is also conceivable that the switch element is disposed on the coupling assembly.

It is moreover advantageous for the ejector to assume an arrested position with the coupling assembly when the ejector in the case of the opening procedure returns in the closing direction from a terminal position to a standby position.

For example, the standby position forms a starting position of the movement of the ejector in the case of the closing procedure of the movable furniture part for charging the force accumulator by way of the coupling assembly, in particular, when the ejector comes into contact with the entrainment element.

The standby position may be reached by the ejector, for example, when the entrainment element departs from the ejector, this being implementable by corresponding positioning of the switch element, for example, by way of a gate-type guide, and then covers a predefined distance of a path, in particular, a few millimeters, in the closing direction until the switch element is operationally connected to the coupling assembly.

In a design embodiment of the present invention that is moreover advantageous, the ejector in the standby position is under a bias.

The ejector in the standby position may be under a compressive force.

Advantageously, the complete coupling assembly in the standby position is under a bias; in particular, a coupling member, for example, a lever, is under a bias by a compressive force.

It is moreover preferable for the ejector to be coupled to the coupling assembly for a charging procedure in such a manner that a compressive force is transmitted from the ejector to the coupling assembly.

In this manner, the entire system of ejector, coupling assembly, and force accumulator, is in an operationally ready position which is under a slight compressive force, for example, for charging the force accumulator such that the system, without any kind of "idle motion", may transmit a force impinging the entrainment element directly to the force accumulator, on account of which clicking noises, for example, or other noises which arise when a "loose" system is rapidly biased, may be avoided.

It is moreover preferable for the switch element to have a hooked portion which serves as a stop for an entrainment element, so as to be able to displace the ejector to a terminal position in the case of the opening procedure.

Unequivocal positioning of the ejector is ensured by this measure. The ejector may preferably be released from the entrainment element only once the ejector has reached a terminal position.

The hooked portion which in this state bears on the entrainment element is favorably moved away such that the entrainment element may be disengaged from the ejector.

Respective positioning of the switch element in particular, by way of the hooked portion on the ejector may be established, for example, by moving the switch element along a guide track, for example, a gate-type guide. On account thereof, the position of the switch element in relation to the ejector is, in particular, forcibly controlled, that is to say that a predefined position of the ejector results in a predefined position of the switch element on the ejector.

It is moreover preferable for the switch element to be pivotably disposed on the ejector.

By way of this course of action, the switch element may be made to disengage from an entrainment element by a simple pivoting movement, or to engage with the entrainment element by a simple pivoting movement, respectively.

On the other hand, the switch element in a pivoted position may ensure coupling of the coupling assembly to the ejector, for example, when the ejector in the case of the opening procedure returns in the closing direction from the terminal position thereof to a standby position.

Herein, the switch element advantageously pivots such that a certain return path of the ejector is permissible, but that the ejector by way of the respectively positioned switch element comes to bear on an element of the coupling assembly, an onward movement only being possible by charging the force accumulator, for example, by tensioning springs in the force accumulator.

In one preferred design embodiment of the present invention, the switch element is a latch element. A latch element may be simply disposed in a pivotable manner, in particular, on the ejector and be positionally controlled in a corresponding manner. In order for the switch element to be controlled it is moreover proposed that the switch element in the case of a movement of the ejector is guided by guide means on a basic part.

For example, the switch element, in particular, the latch element, in the case of a movement of the ejector by way of a gate is guided to a predefined desired position, or is transferred thereto, respectively. The gate is preferably configured on the basic part.

Moreover, it is favorable for the guide means to comprise a closed track.

By way of this measure, folding out and folding in of the switch element, in particular, of the latch element, in the case of a "to and fro movement" of the ejector may be forcibly controlled in a simple manner such that the latch element in each position of movement of the ejector assumes a desired predefined position, wherein positioning is repeated following a completed, for example, linear, to and fro movement, preferably in a circulation direction on the track.

BRIEF DESCRIPTION OF THE DRAWINGS

Further features and advantages of the present invention are explained in more detail by means of exemplary embodiments which are schematically illustrated in the figures.

DETAILED DESCRIPTION OF THE INVENTION

Figure 1:
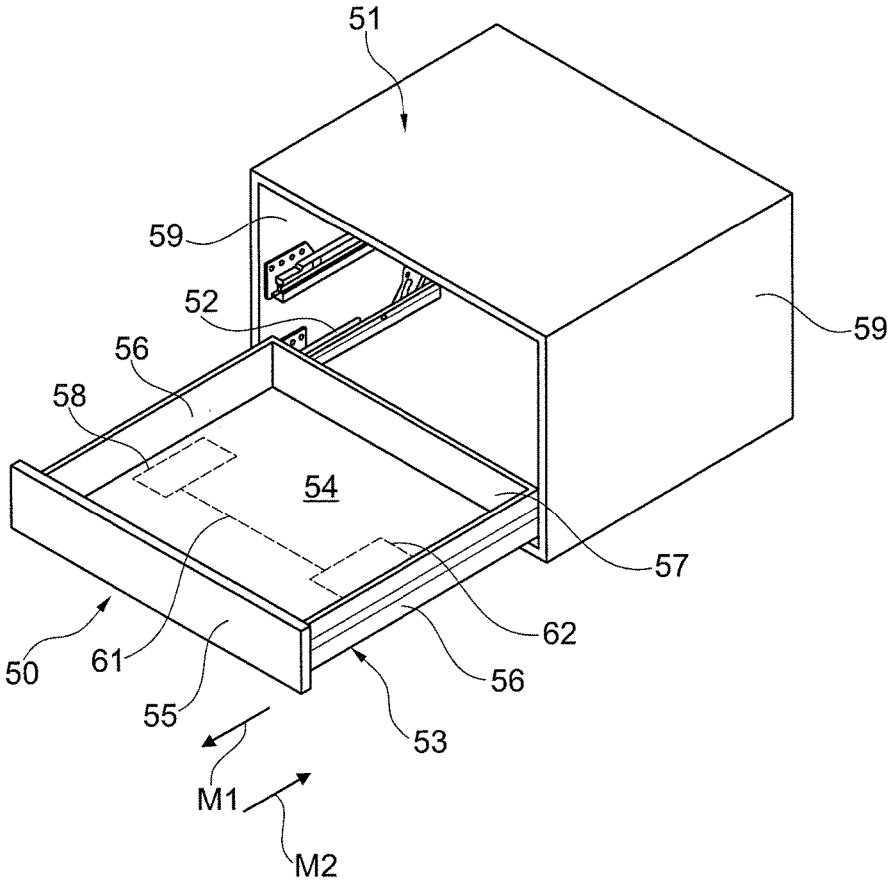
FIG. 1 shows an item of furniture according to the present invention in a perspective view from obliquely above, having a drawer in the completely opened state on a basic furniture structure.

An item of furniture 50 according to the present invention, having a box-shaped basic furniture structure 51 and a drawer 53 which by way of guide means 52 is movably guided, is illustrated in FIG. 1. The drawer 53 comprises a drawer base 54, a drawer front 55, two mutually opposite side walls 56, and a rear drawer wall 57. Two guide means 52 with identical action for guiding the drawer 53 are present in each case between each side wall 56 of the drawer 53 and an associated basic-structure side wall 59. A device 58 according to the present invention (illustrated with dashed lines), for moving or ejecting, respectively, the furniture part which is configured as a drawer 53 in the opening direction M1 is disposed on a lower side of the drawer base 54.

Figure 2:
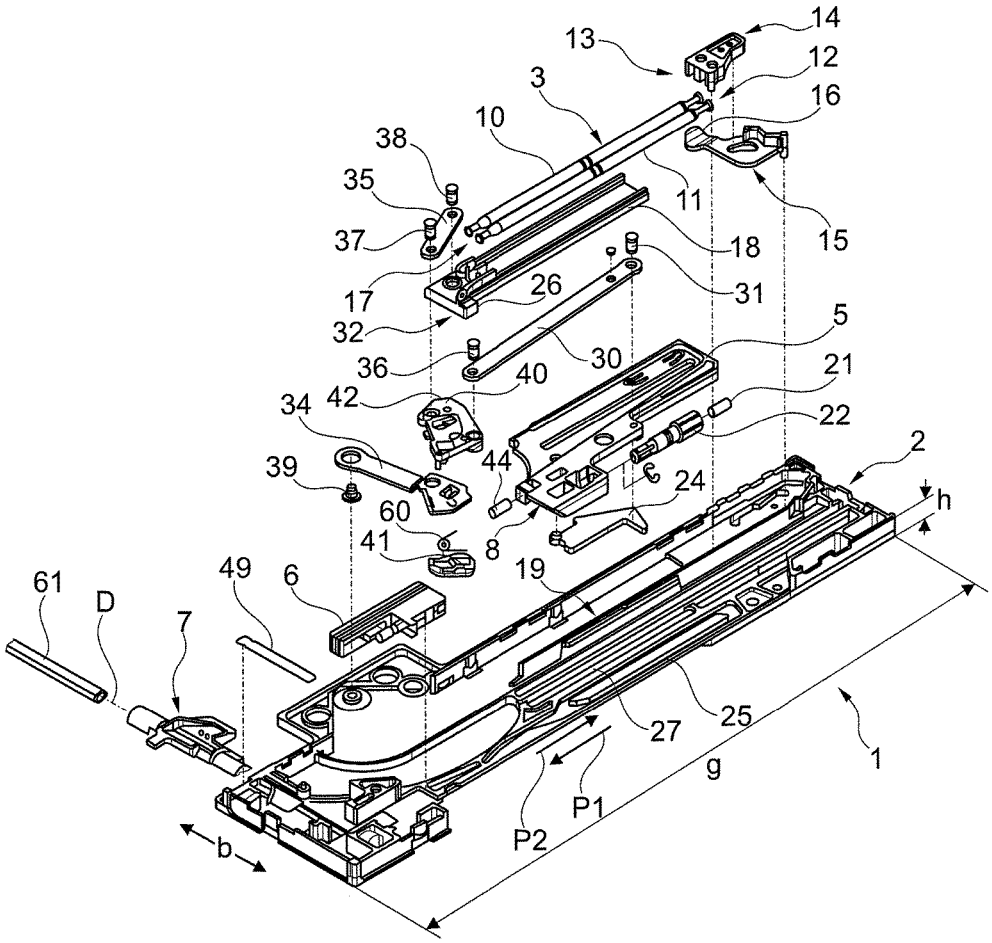
FIG. 2 shows a device according to the present invention, without a cover component, in an exploded illustration.

FIG. 2 shows the exploded illustration of the device 58 which is configured as an ejector unit 1 for the drawer 53.

The ejector unit 1 serves for the force-assisted ejection of the drawer 53 across a first part-distance of the opening movement of the drawer 53 in relation to the basic furniture structure 51, from a closed position in the opening direction M1 of the drawer 53.

The drawer 53 by way of the guide means 52, for example, two identical part-pullout units or full-pullout units, is mounted on the basic furniture structure 51 so as to be displaceable in the directions M1 and M2.

Alternatively, the ejector unit 1 may be disposed on the basic furniture structure 51 or on the guide means 52 of the item of furniture 50.

The ejector unit 1 comprises inter alia base plate 2, a force accumulator 3, a coupling installation 4, an ejector 5, an activation element which is configured as an activator 6, and a locking member 7.

Figure 9:
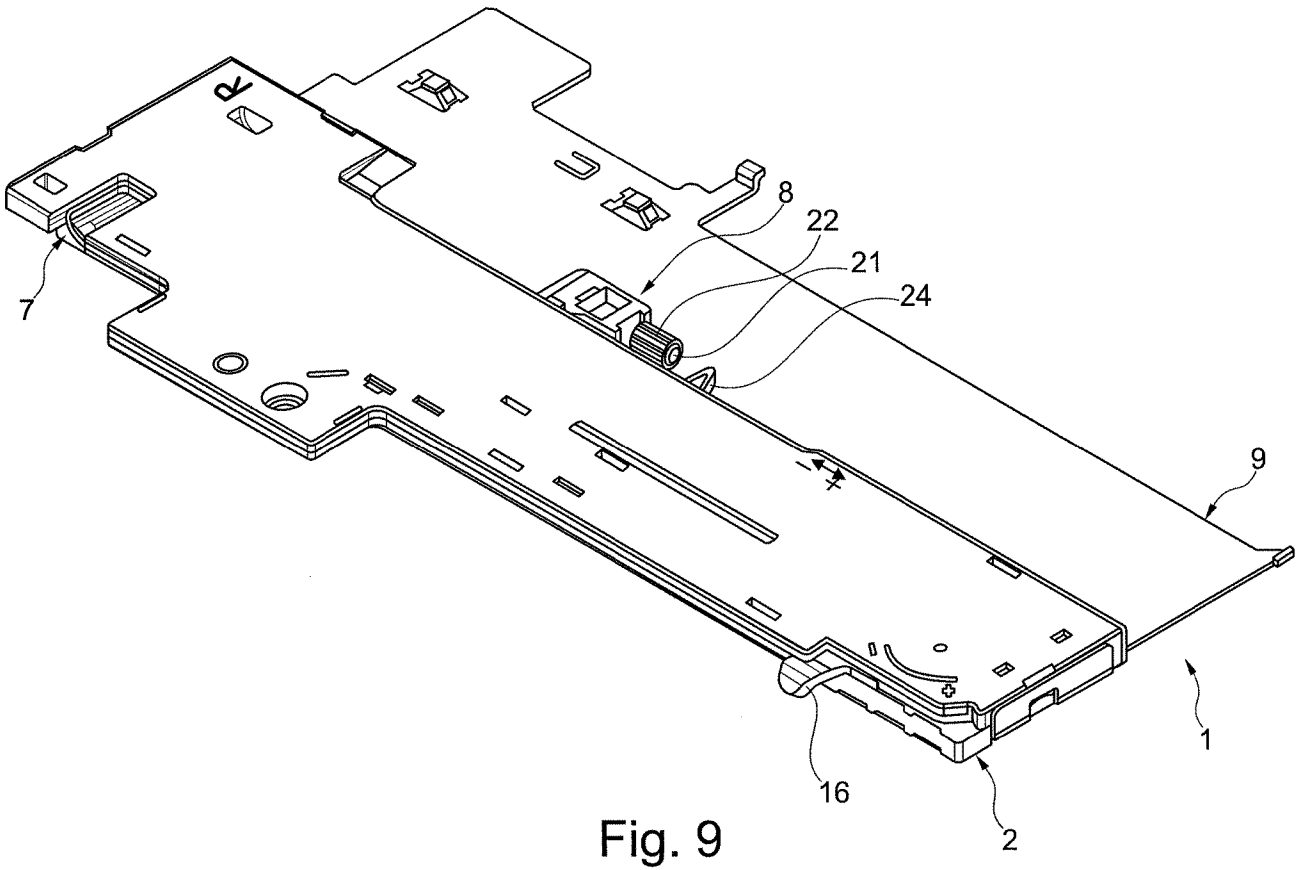
FIG. 9 shows the device according to FIG. 5, having the cover component, in a perspective view from obliquely below toward a second main side of the device.

A housing of the ejector unit 1 comprises the base plate 2 and a cover component 9 which is visible in FIG. 9. The ejector unit 1 may be disposed on the lower side of the drawer base 54 and/or on the guide means 52 by way of the housing or by way of the cover component 9 and/or the base plate 2, respectively.

Retaining portions, guide contours, stop members, and/or receptacle portions for linking the individual components of the ejector unit 1 are configured on the base plate 2. The base plate 2 is designed substantially as a rectangular, elongate or strip-shaped component, having a comparatively minor height h of approx. 5 to 15 millimeters, for example. The base plate 2 furthermore has a width b of approx. 4 to 10 centimeters, and a length g.

According to the exemplary embodiment shown, the force accumulator 3 comprises two identical coil springs 10, 11 which configure a spring pack and which are disposed in parallel. At a first end 12 of the force accumulator 3, the coil springs 10, 11 are disposed on an adjustable fixed mounting 13. The fixed mounting 13 comprises a movable mounting part 14 on which the coil springs 10, 11 are received in a releasable yet fixed manner, and a set part 15 having an operating portion 16 by way of which a user may adjust from the outside a position of the end 12 of the force accumulator 3 in a modifiable and positionally fixed manner. On account thereof, an effect of force of the force accumulator 3 on the drawer 53 may advantageously be pre-adjusted in the case of the opening procedure of the drawer 53.

The associated ends of the coil springs 10, 11 are fastened to a slide-type motion element 18 at a second end 17 of the force accumulator 3. The slide-type motion element 18 by way of an associated guide contour 19 is linearly guided on the base plate 2 so as to be movable in a movement direction P1 and in an opposite movement direction P2.

The movement directions P1 and P2 of the motion element 18 (cf. FIGS. 2 and 3) run parallel with the opening direction M1 of the drawer 53 and with a closing direction M2 which is counter thereto.

If and when the ejector unit 1 is disposed in a positionally fixed manner on the basic furniture structure 51 and/or on a stationary part of the guide means 52, the opening direction of the drawer 53 corresponds to the direction P1, and the closing direction of the drawer 53 corresponds to the direction P2.

Hereinbelow, an assembled state of the ejector unit 1 on the drawer base 54 is assumed.

Figure 3:
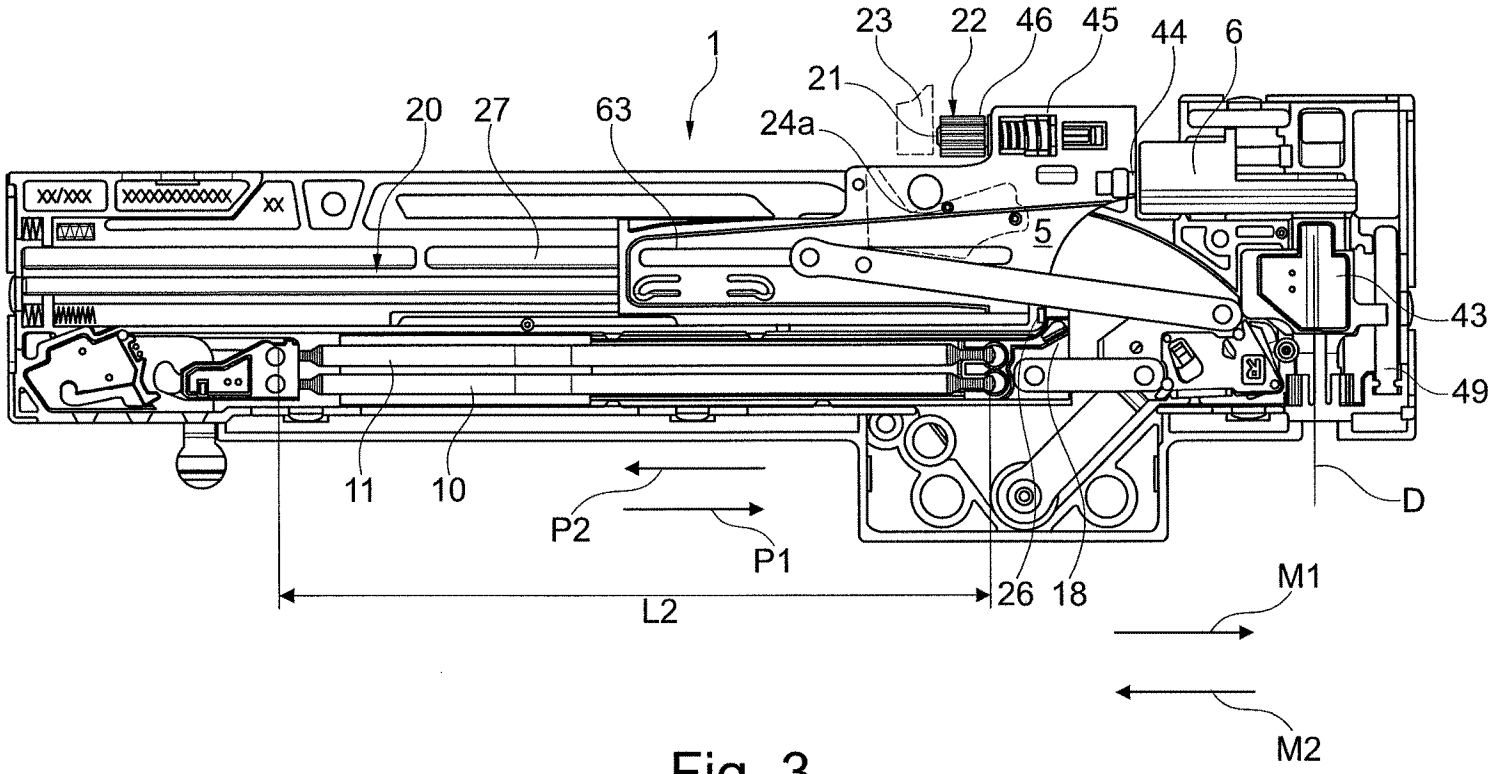
FIGS. 3 to 8 show the device according to FIG. 2, in the assembled state, in a plan view of a first main side, in various operational states.
Figure 7:
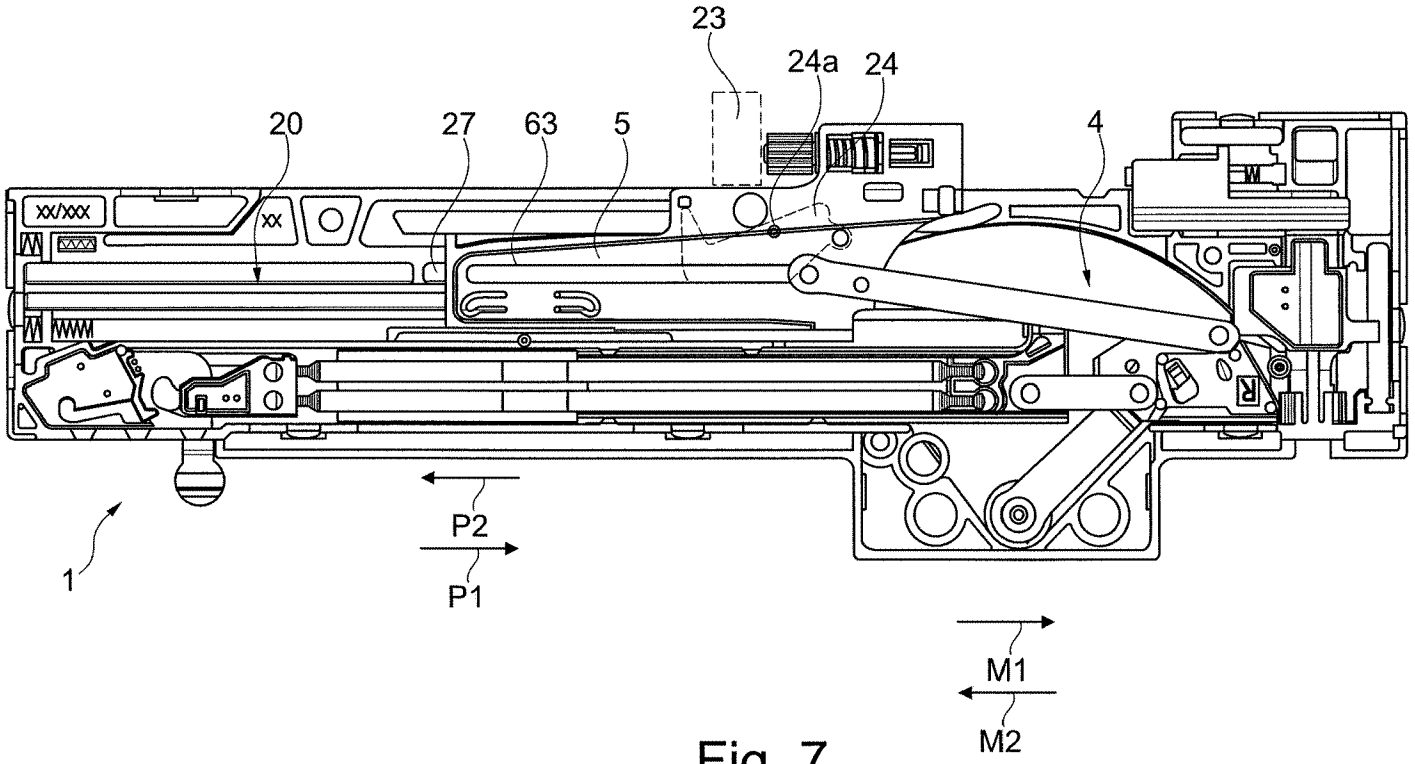
Figure 8:
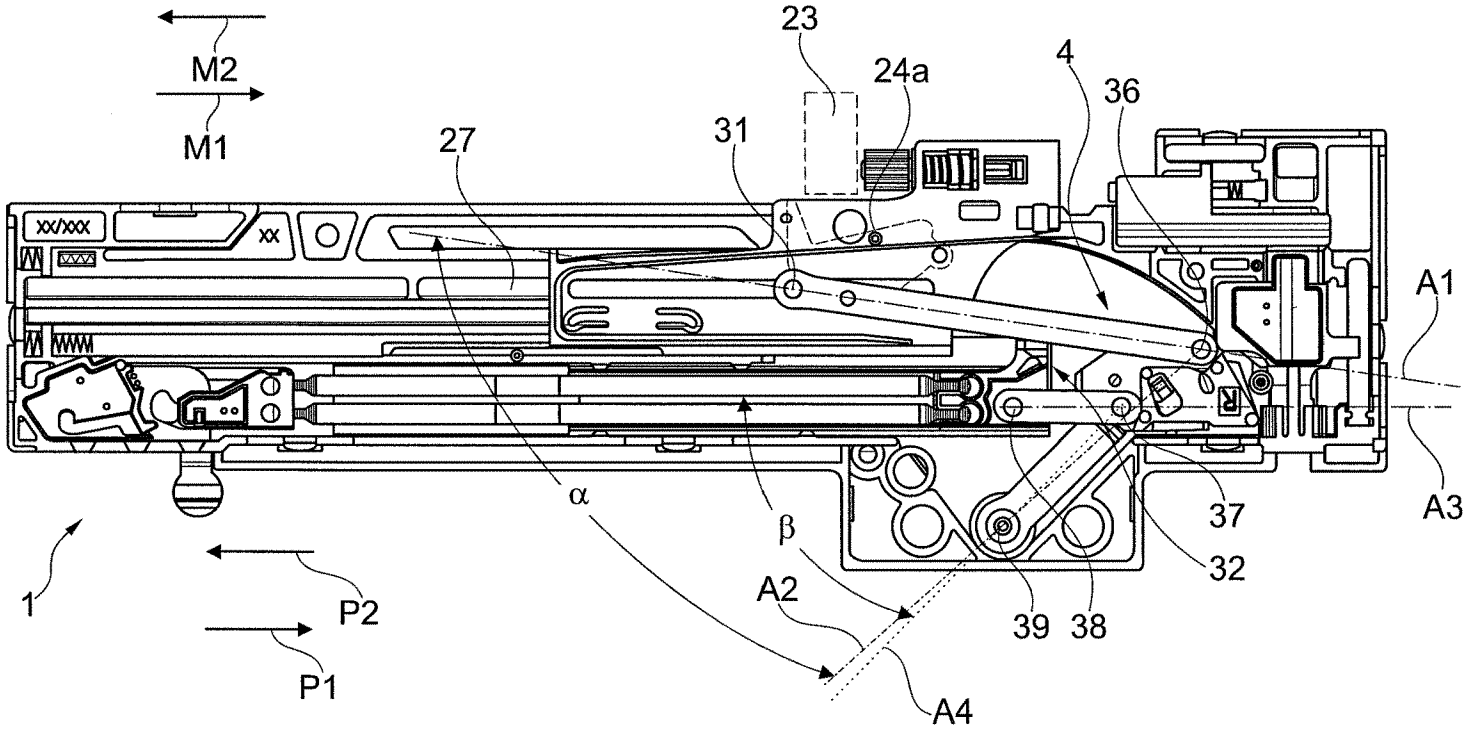

FIGS. 3, 7 and 8 show the ejector unit 1 in a tensioned state of the force accumulator 3, in which the coil springs 10, 11 are elongated or are tensioned so as to be under a tensile load, respectively; herein, the motion element 18 in relation to a retracted position in the direction P2 is offset on the base plate 2 in the direction P1 and is retained in a tensioned position.

Figure 5:
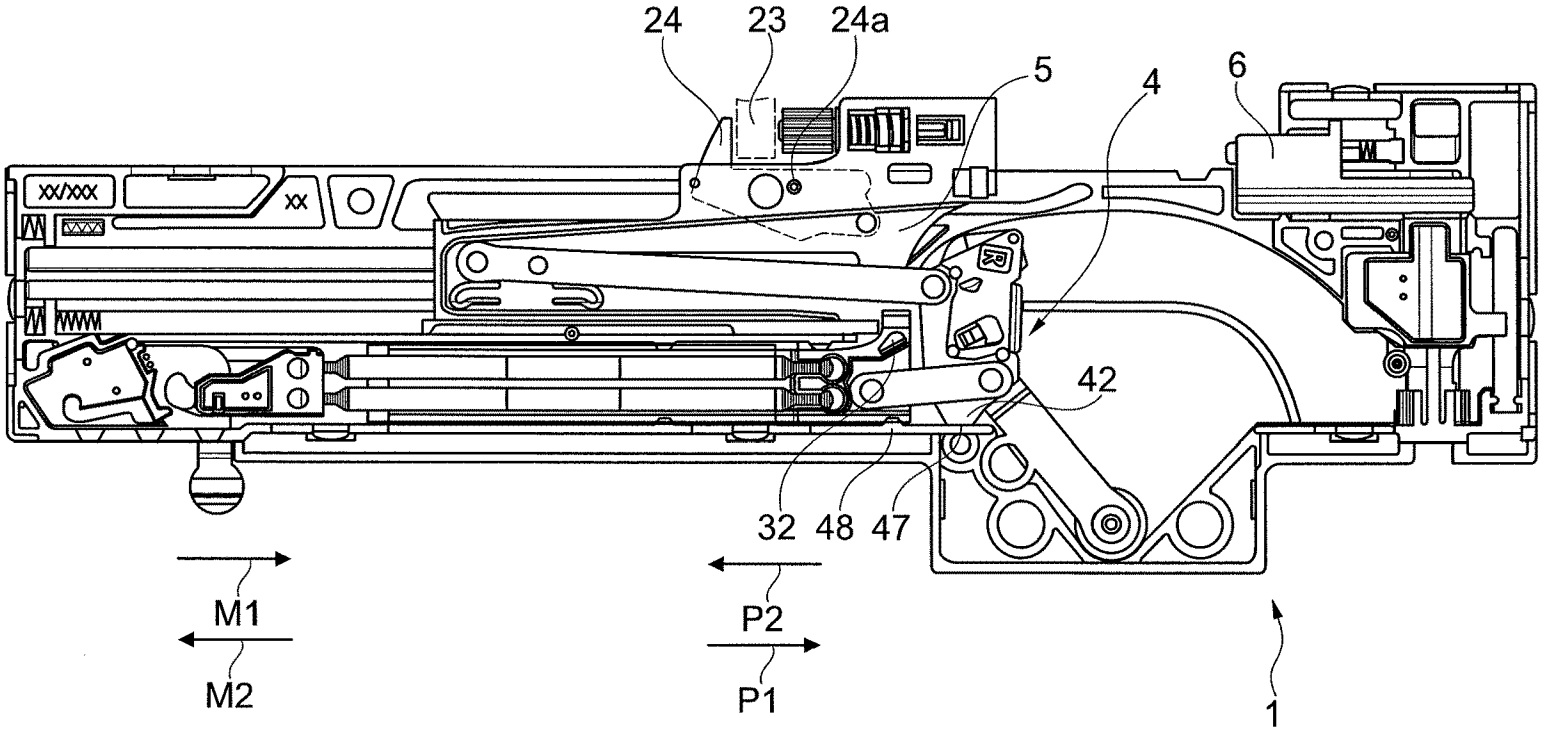
Figure 6:
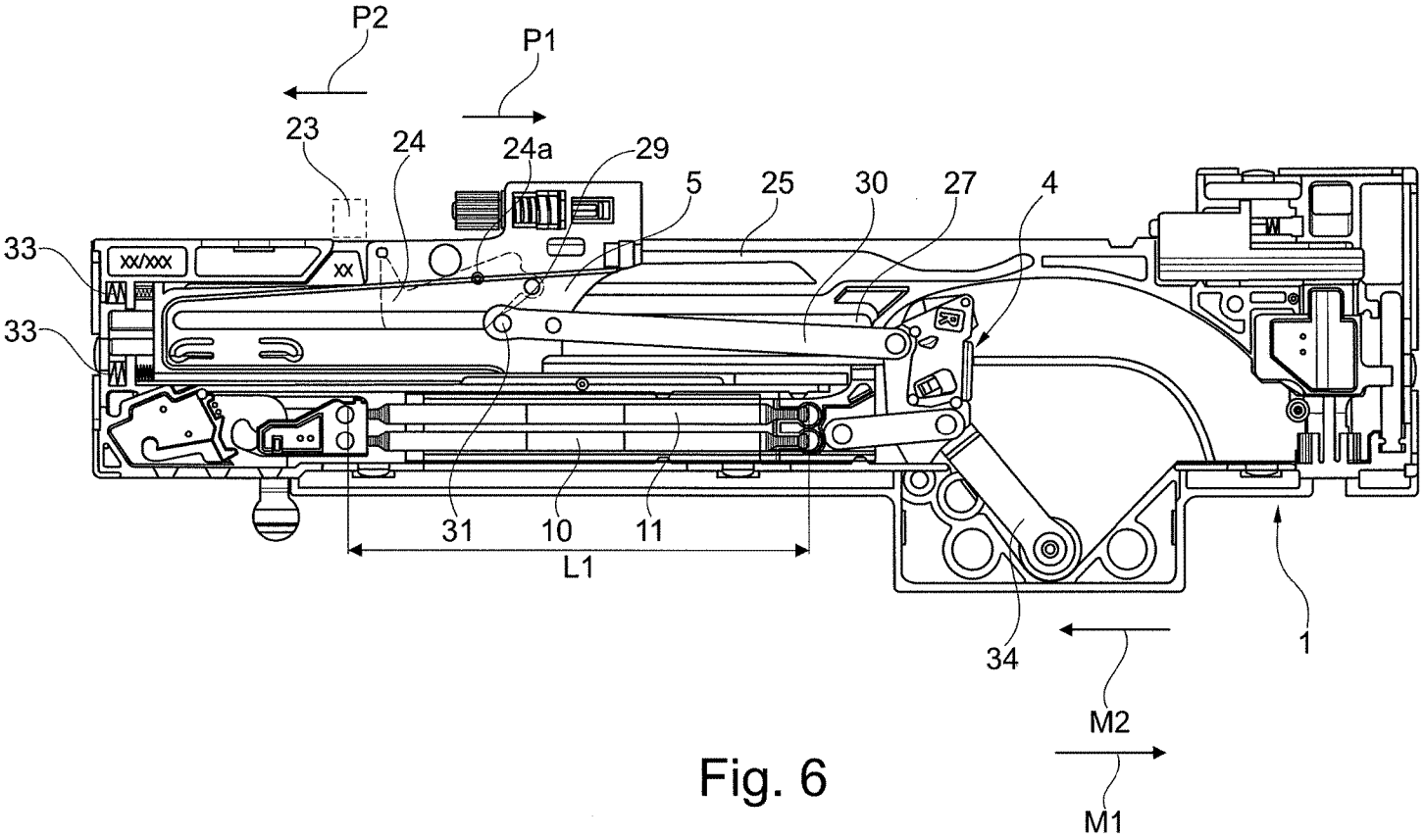

FIGS. 5 and 6 show the ejector unit 1 in a discharged basic state of the force accumulator 3, in which the coil springs 10, 11 are furthermore biased under a tensile load but to a lesser degree, and have a length L1.

In the tensioned state of the force accumulator 3, the coil springs 10, 11 have a length L2 which is greater than L1.

A retaining member 32 having a stop element 26 which in the case of an ejection procedure of the furniture part is in contact with an ejector 5 is present on the motion element 18.

By way of the coupling installation 4, the force accumulator 3 or the motion element 18, respectively, is operationally connected to the ejector 5, preferably exclusively in the case of the closing procedure of the drawer 53. The ejector 5 is movable to and fro in the directions P1 and P2, in particular, exclusively movable in a linear manner, or so as to be parallel with the movement direction of the motion element 18, respectively. To this end, a linear guide 20 which is adapted to guide portions, for example, on one side of the ejector 5, is configured on the base plate 2.

Figure 4:
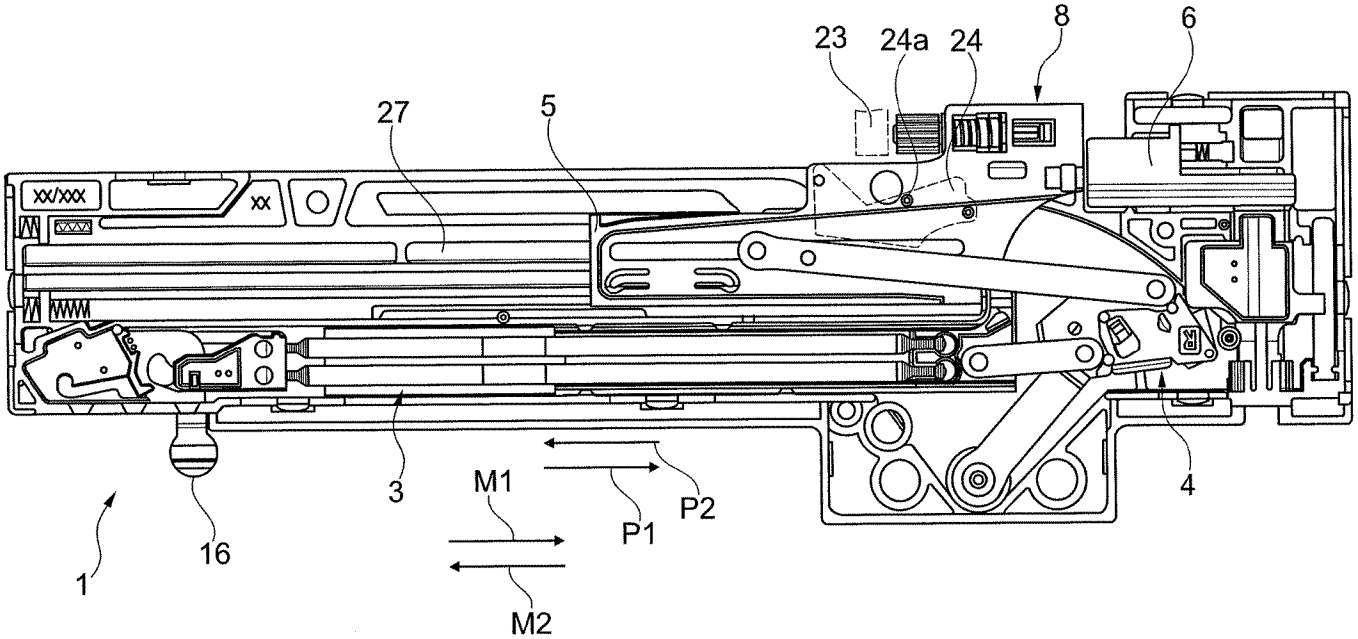

An opening procedure of the drawer 53, caused by the ejector unit 1, takes place exclusively by way of a direct operational connection of the force accumulator 3 to the ejector 5, by way of the motion element 18 which moves in the direction P2. To this end, the stop element 26 which is advantageously designed so as to be elastic and thus prevents or at least dampens any sound which is disturbing to the user when the motion element 18 impacts the ejector 5 in the opening procedure of the drawer 53 is configured on the motion element 18 (FIGS. 3, 4 and 5).

A front-gap adjustment assembly 8 which is configured on the ejector 5 comprises a housing 45 and a set screw 22 having a contact portion 21. The set screw 22 has an external thread which interacts with an internal thread on the housing 45. Depending on the rotation direction, a position of the contact portion 21 of the set screw 22 is adjustable in the direction P1 or P2 by manual rotation of an operating portion 46 of the set screw 22 by a user. In particular, the set screw 22 is configured so as to be self-locking in relation to the housing 45. A measure of a front gap between the drawer front 55 of the drawer 53, which is closed on the basic furniture structure 51, and end sides of the basic furniture structure 51 is capable of being predefined by way of the predefined position of the set screw 22.

The contact portion 21 of the set screw 22 in the tensioned or charged state, respectively, of the force accumulator 3 bears on an entrainment element 23 which in respective operational states forms a stop for the contact portion 21. The entrainment element 23 which in FIGS. 3 to 8 is merely indicated by dashed lines may be present on a fixed rail of the guide means 52, for example, or be attached to the basic furniture structure 51 when the ejector unit 1 is disposed on the drawer 53.

However, if and when the ejector unit 1 is disposed on the basic furniture structure 51 or on a positionally fixed part of the guide means 52 of the item of furniture 50, the entrainment element 23 may be present on the drawer 53 and thus be movable in relation to the basic furniture structure 51.

If and when, proceeding from the basic position of the ejector unit 1 according to FIG. 3, a locking feature is cancelled on the ejector unit 1, as is shown in FIG. 4 and will be explained in more detail below, the tensioned or charged force accumulator 3, respectively, pulls the motion element 18 in the direction P2, the latter by way of the stop element 26 urging or sliding, respectively, the ejector 5 in relation to the base plate 2 in the direction P2.

As soon as the ejector 5 on the base plate 2 moves in the direction P2, a latch component 24 of the ejector unit 1, which is pivotably mounted on the ejector 5, is put from an inwardly pivoted position according to FIG. 4, in which the latch component 24 in relation to an external periphery of the base plate 2 is completely retracted, to an outwardly pivoted position in which the latch component 24 by way of a lug partially projects beyond the external periphery of the base plate 2 (FIG. 5), this being implemented by way of a loop-shaped closed guide track 25 in the base plate 2 and by way of a guide pin 24*a*, engaging in the guide track 25, on the latch component 24.

In order for the latch component 24 to be illustrated, the outline thereof which is obscured by other components, in particular, by the ejector 5, in FIGS. 3 to 8 is indicated with dashed lines.

In the basic state which is illustrated in FIG. 5, the force accumulator 3 is located in a terminal position of the discharged state, wherein the force accumulator 3 is unable to move the ejector 5 any farther in the direction P2.

By virtue of the kinetic energy of the drawer 53, caused by the preceding ejection movement, and/or by a user manually moving the drawer 53 farther in the opening direction M1, the ejector 5 is subsequently displaced in relation to the base plate 2 in the direction P2. This is possible because the latch component 24 which has been outwardly pivoted so as to project from the ejector 5 bears on the entrainment element 23, the ejector 5 in the further course of the movement of the drawer thus reaching the terminal position thereof which is displaced to a maximum in the direction P2 on the base plate 2. By reaching the terminal position on the ejector 5, the latch component 24 is again completely pivoted inwardly, this being predefined by the interaction between the guide track 25 and the guide pin 24*a* engaging therein on the latch component 24.

If and when the drawer 53 following a discharging procedure of the force accumulator 3 is moved farther in the opening direction M1, the ejector unit 1 separates from the entrainment element 23, cancelling, in particular, also the contact between the entrainment element 23 and the contact portion 21 of the set screw 22 (FIG. 6).

From the terminal position described above, which the ejector assumes only briefly, the ejector 5 by spring elements 33 on the base plate 2 is urged by a few millimeters in the direction P1, for example. In relation to the coil springs 10, 11 of the force accumulator 3, the spring elements 33 have a comparatively minor force. By way of the movement of the ejector 5 in the direction P1 by way of the force of the spring elements 33, a bearing portion 29 of the latch component 24 in a standby position of the ejector 5 is put in direct clearance-free contact with a mounting pin 31 of a tension lever 30 of the coupling installation 4 (FIG. 6). The mounting pin 31 is disposed on a first end of the tension lever 30 and may move freely along a, for example, linear, guide track 27 and/or a linear guide 63 which is configured on the ejector 5 for so long, and, in particular, within an opening procedure of the drawer 53, until the latch component 24 holds the mounting pin 31 and/or the tension lever 30 in direct, clearance-free contact with the ejector 5.

The standby position of the ejector 5 which is shown in FIG. 6 at the same time is also a starting position of the ejector 5 for a charging procedure of the force accumulator 3 by way of the coupling installation 4.

Besides the tension lever 30, the coupling installation 4 comprises a guide lever 34 and a connection element 35. By way of a mounting pin 36, the tension lever 30 on a second end is articulated on the guide lever 34. The connection element 35, on a second end, by way of a mounting pin 37 which is spaced apart from the mounting pin 36, is likewise articulated on the guide lever 34, and on the first end thereof, the connection element 35 by way of a further mounting pin 38 is articulated on the motion element 18. The guide lever 34 at a first end by way of a mounting pin 39 is disposed so as to be movable, in particular, pivotable, on the base plate 2. The mounting pin 39 is preferably received both on the base plate 2 as well as on the cover component 9.

A longitudinal axis A1 of the tension lever 30, which runs through the mounting pins 31, 36 of the tension lever 30, in relation to a first longitudinal axis A2 of the guide lever 34, which runs through the mounting pins 36, 39, has an angle $\alpha$.

A longitudinal axis A3 of the connection element 35, which runs through the mounting pins 37, 38 of the connection element 35, in relation to a second longitudinal axis A4 of the guide lever 34, which runs through the mounting pins 37, 39, has an angle $\beta$.

The guide lever 34 of the coupling installation 4, on a second end, comprises a lever attachment 40. A locking element 41 and a stop element 42 are configured on the lever attachment 40.

The terminal position of the discharged state of the force accumulator 3 (FIG. 5) is predefined by a stop of the stop element 42 of the guide lever 34 on a wall portion 47 on a step-type wall 48 of the base plate 2. The wall portion 47 is formed from an annular portion of a damping element, for example. If and when the stop element 42 of the guide lever 34 following a discharging procedure of the force accumulator 3 bears on the wall portion 47, by virtue of a remaining bias of the coil springs 10, 11 a tensile force in the direction P2 is transmitted from the motion element 18 by way of the connection element 35 to the guide lever 34. By virtue of the rigid embodiment of the coupling installation 4, or by virtue of the impact of the stop element 42 on the wall portion 47, respectively, the motion element 18 is prevented from moving farther in the direction P2, wherein the force accumulator 3 by way of the motion element 18 is held free of clearance in the terminal position of the discharged state.

In particular, the stop element 42 and/or the wall portion 47 may be designed so as to be elastic or damping, respectively, thus reducing or preventing an impact noise.

When tensioning the force accumulator 3, the guide lever 34 by virtue of the design thereof may transmit a force from the tension lever 30 to the connection element 35 at a geared up ratio.

The geared up transmission ratio is formed, on the one hand, by the ratio of the spacing of the mounting pins 39 and 36 in relation to the spacing of the mounting pins 39 and 37 on the guide lever 34 and, on the other hand, by the combined mutual circular and linear movement of the tension lever 30 and/or of the connection element 35 during the charging procedure of the force accumulator 4.

The elements of the coupling installation 4, by virtue of the arrangement of the former on the ejector unit 1, may move as follows:

The mounting pin 31 and thus the first end of the tension lever 30, by virtue of the mounting thereof in the guide track 27, may move exclusively parallel with a movement direction of the ejector 5, in particular, parallel with a movement direction of the movable furniture part 53.

The mounting pin 38 and thus the first end of the connection element 35, by virtue of the mounting thereof on the slide-type motion element 18 and thus advantageously in the guide contour 19, may move exclusively parallel with a movement direction of the motion element 18 or of the ejector 5, respectively, in particular, parallel with the movement direction of the movable furniture part 53.

The mounting pin 36 and thus the second end of the tension lever 30, by virtue of the mounting thereof at the second end of the guide lever 34, may move exclusively in a circular path about a rotation center of the mounting pin 39 of the guide lever 34.

The mounting pin 37 of the connection element 35 and thus the second end of the connection element 35, by virtue of the mounting thereof in a central region of the guide lever 34, may move exclusively in a circular path about a rotation center of the mounting pin 39 of the guide lever 34.

By virtue of the above-mentioned design, the coupling installation 4 may transmit at a geared up ratio a force for tensioning the force accumulator 3 from the ejector 5 by way of the tension lever 30 and of the guide lever 34 to the connection element 35 and thus to the force accumulator 3, and, in particular, the coupling installation 4 transmits the force which is exerted by the ejector 5 in a geared down ratio to the force accumulator 3. This means that a user when charging the force accumulator 3 has to apply less force to the ejector 5 than the user would have to apply when wishing to charge the force accumulator 3 without a geared down ratio, or when directly pulling the end 17 of the force accumulator 3 in the direction P1, respectively.

The beginning and the end of the charging procedure of the force accumulator 3 or of the coil springs 10, 11, respectively, is visualized in FIGS. 6 and 7.

Tensioning of the force accumulator 3 is performed by a movement of the drawer 53 in the case of closing, or on a part-distance of the closing movement of the drawer 53. The starting position of the ejector unit 1, in which the latter is prepared for tensioning of the force accumulator 3 and expects a closing procedure of the drawer, is shown in FIG. 6.

If and when the drawer 53 is closed, for example, from the outside by a user, the ejector unit 1 moves in the direction M2 toward the entrainment element 23. The charging procedure of the force accumulator 3 begins as the contact portion 21 of the set screw 22 of the ejector 5 impacts on the entrainment element 23. The ejector 5, by impacting on the entrainment element 23, is moved in the direction P1, for example, by virtue of the inertia of the drawer 53 in relation to the base plate 2.

By way of the coupling of the ejector 5 to the force accumulator 3 by way of the coupling installation 4, the motion element 18 of the force accumulator 3 is likewise displaced in relation to the base plate 2 in the direction P1, and the second end 17 of the coil springs 10, 11 is displaced in the direction P1, the coil springs 10, 11 thus being elongated.

At the end of the tensioning procedure of the force accumulator 3, the ejector 5 is located in a terminal charging position, as is shown in FIG. 7. In the tensioned state of the force accumulator 3, the ejector unit 1 is located in a locked state.

In the locked state, a locking state is determined by the locking element 41 of the coupling installation 4 and by the locking member 7 which is configured as a flap, wherein a discharging movement of the coupling installation 4 is blocked by the locking member 7.

Tensioning of the force accumulator 3 is fully completed prior, for example, to an automatic retracting feature for the force-assisted retraction of the drawer 53 into the fully closed closing position on the basic furniture structure 51 becoming effective. The automatic retracting feature is not part of the ejector unit 1, and is integrated, for example, in the guide means 52 or in the part-pullout units or full-pullout units, respectively.

After the force accumulator 3 has been tensioned, the ejector 5 by virtue of bearing on the entrainment element 23 is moved in the direction P1 in relation to the base plate 2 by way of the further closing movement of the drawer 53. Herein, the operational connection between the latch component 24 of the ejector 5 and the mounting pin 31 of the tension lever 30 is cancelled. This is performed by an interaction between the guide track 25 and the guide pin 24*a* on the latch component 24, wherein the latch component 24 by the guiding of the guide pin 24*a* in the guide track 25 is pivoted away from the mounting pin 31 (FIG. 8). In this state, the ejector 5 is uncoupled from the coupling installation 4 and is displaceable so far in the direction P1, in particular, by an automatic retracting feature, until the drawer 53 is fully closed on the basic furniture structure 51, and the ejector 5 bears on the activator 6 in the basic position according to FIG. 3.

In the basic position of the ejector unit 1 according to FIG. 3, it is possible for a user to manually pull the drawer 53 in the opening direction M1 without an ejector function or without first cancelling the locking state, respectively. Herein, the force accumulator 3 of the ejector unit 1 remains non-actuated or charged, respectively.

In order for the drawer 53 by way of the ejector unit 1 to be expelled from the position in which the drawer 53 is completely retracted or closed, respectively on the basic furniture structure 51, a user has to act on the drawer while pushing from the outside in the direction M2. To this end, the ejector unit 1 has a so-called touch-latch function which knows a locked state which is unlockable in that the retracted drawer 53 which is closed on the basic furniture structure 51 is moved in the closing direction M2. This closing movement, or inward pushing of the drawer 53 in the direction M2, respectively, is performed until a stop position corresponding to a front gap which in the closed state of the drawer 53, is predefined, in particular, by way of a spacing between an internal side of the drawer front 55 and a forward end side or the side walls 56 of the basic furniture structure 51, respectively, is reached. The front gap is typically a few millimeters, for example, approx. 1 to 10 millimeters.

Accordingly, unlocking of the ejector unit 1 is adapted in such a manner that a closing movement of the drawer 53 in the direction M2 of a few millimeters, or at maximum by the value of the front gap, respectively, is sufficient for the unlocking and thus the force-assisted ejection of the drawer 53 to be reliably predefined.

Proceeding from the basic position according to FIG. 3, the ejector unit 1 together with the drawer 53 is moved in the direction M2. Since the set screw 22 bears on the entrainment element 23, the ejector 5 is moved in relation to the base plate 2 in the direction P1, a contact portion 44 on the ejector 5 thus pressing against the activator 6, accordingly pushing the latter in the direction P1. The activator 6 is present on the base plate 2 so as to be linearly displaceable in a limited manner, typically by a few millimeters or by less than the dimension of the front gap, respectively, in the directions P1 and P2.

The activator 6 is preferably directly coupled to the locking member 7 which is designed as a flap 43 in such a manner that the linear activation movement of the activator 6 in the direction P1 sets the flap 43 in rotary motion about a pivot axis D. The flap 43 by way of the rotating movement is released from an arrested position into which the flap 43 is urged by a spring member which is configured as a leaf spring 49. In the locked state of the ejector unit 1, the flap 43 which is located in the arrested position blocks the guide lever 34 or the lever attachment 40, respectively, in such a manner that the force accumulator 3 remains in the charged state thereof.

Blocking of the guide lever 34 is cancelled by the rotating movement of the flap 43. The locking element 41 on the lever attachment 40, which is biased by a leg spring 60, hereby preferably pivots out.

The locking element 41, which projects from the lever attachment 40, moves conjointly with the pivoting procedure of the guide lever 34 below the flap 43, past the latter, and continues without interruption the rotating movement of the flap 43, initiated by the activator 6, about the pivot axis D. On account thereof, a rotation angle of the flap 43 out of the locking position is advantageously enlarged. The ejector unit 1 is reliably unlocked by the movement of the lever attachment 40 below and past the flap 43 and continued by the outwardly pivoting locking element 41. To this end, a comparatively very minor linear activation movement of the activator 6 in the direction P1 is advantageously required. Subsequently, the flap 43 by way of the leaf spring 49 is urged back into the arrested position of the former.

The locking element 41 which is present outwardly pivoted on the lever attachment 40 is again brought to bear on a front edge of the flap 43 when the force accumulator 3 is tensioned. Herein, the locking element 41 yields counter to the spring force of the leg spring 60, such that the locking element 41 is retracted so far on a periphery of the lever attachment 40 that the guide lever 34 by way of the lever attachment 40 can pivot past the flap 43.

Behind the flap 43, the locking element 41 is outwardly pivoted again by the spring force of the leg spring 60. Following the tensioning procedure, the guide lever 34 by way of the projecting locking element 41 is pushed against the flap 43 which is held by the leaf spring 49 so as to lock, the force accumulator 3 thus being in the locked state.

The rotating movement of the flap 43 of the ejector unit 1, or of the device 58, respectively, is transmitted by a synchronizer bar 61 which is disposed so as to be rotationally fixed on the flap 43 to a second device 62 which is advantageously of identical action and which is disposed on the drawer 53.

The synchronizer bar 61 advantageously connects the locking member 7 to a second locking member which is present on the second device 62. The two locking members are thus directly and/or synchronously coupled in terms of motion. This represents a synchronizing principle which is contrary to a connection between activator elements of two ejector devices on one furniture part.

LIST OF REFERENCE SIGNS

1 Ejector unit
2 Base plate
3 Force accumulator
4 Coupling installation
5 Ejector
6 Activator
7 Locking member
8 Front-gap adjustment assembly
9 Cover component
10 Coil spring
11 Coil spring
12 End
13 Fixed mounting
14 Mounting part
15 Set part
16 Operating portion
17 End
18 Motion element
19 Guide contour
20 Linear guide
21 Contact portion
22 Set screw
23 Entrainment element
24 Latch component
24*a* Guide pin
25 Guide track
26 Stop element
27 Guide track
29 Bearing portion
30 Tension lever
31 Mounting pin
32 Retaining member
33 Spring element
34 Guide lever
35 Connection element
36 Mounting pin
37 Mounting pin
38 Mounting pin
39 Mounting pin
40 Lever attachment
41 Locking element
42 Stop element
43 Flap
44 Contact portion
45 Housing
46 Operating portion
47 Wall portion
48 Wall
49 Leaf spring
50 Item of furniture
51 Basic furniture structure
52 Guide means
53 Drawer
54 Drawer base
55 Drawer front
56 Side wall
55 Rear drawer wall
58 Device
59 Basic structure side wall
60 Leg spring
61 Synchronizer bar
62 Device
63 Linear guide

The invention claimed is:

1. A device for moving a movable furniture part in an opening direction in relation to a basic furniture structure of an item of furniture, wherein the device is configured to movably guide the movable furniture part by way of guide means in the opening direction and in a closing direction, which is counter to the opening direction, wherein the device comprises a force accumulator, a coupling assembly and an ejector, such that the device, which is configured to be fitted to the item of furniture, is configured to move the movable furniture part in an opening procedure under the action of the force accumulator by way of the ejector so as to be put in an opening position, wherein the coupling assembly charges the force accumulator in a charging procedure of the force accumulator such that the ejector is in contact with the force accumulator via the coupling assembly coupled therebetween, and wherein a switch element, which is pivotably disposed on the ejector, uncouples the coupling assembly from between the ejector and the force accumulator in the opening procedure such that the ejector is in direct contact with the force accumulator, and the ejector in a region of an end in the opening procedure by way of the switch element is recoupled to the coupling assembly.

2. The device according to claim 1, wherein the switch element on the ejector is configured such that the ejector is operationally connected to the coupling assembly for the charging procedure of the force accumulator when an entrainment element assumes a predefined position in relation to the ejector.

3. The device according to claim 1, wherein the ejector assumes an arrested position with the coupling assembly when the ejector in the opening procedure returns in the closing direction from a terminal position to a standby position.

4. The device according to claim 1, wherein the ejector in a standby position is under a bias.

5. The device according to claim 1, wherein the switch element has a hooked portion which serves as a stop for an entrainment element, so as to be able to displace the ejector to a terminal position in the opening procedure.

6. The device according to claim 1, wherein the switch element comprises a latch element.

7. The device according to claim 1, wherein the switch element in a movement of the ejector is guided by a guide means on a basic part of the device.

8. The device according to claim 7, wherein the guide means on the basic part comprises a closed track.

9. An item of furniture having a movable furniture part in relation to a basic furniture structure, comprising the device according to claim 1.

* * * * *